US005275631A

United States Patent [19]

Brown et al.

[11] Patent Number: 5,275,631

[45] Date of Patent: Jan. 4, 1994

[54] COAL PULVERIZER PURIFIER CLASSIFIER

[76] Inventors: Charles K. Brown, 8317 Robert Bruce Dr., Richmond, Va. 23235; David K. Brown, 1514 Old Lyme La., Midlothian, Va. 23113

[21] Appl. No.: 930,363

[22] Filed: Aug. 17, 1992

[51] Int. Cl.[5] ..... C10L 9/00

[52] U.S. Cl. ..... 44/631; 44/505; 44/629; 44/630; 44/633

[58] Field of Search ..... 44/629, 630, 631, 633, 44/505

[56] References Cited

U.S. PATENT DOCUMENTS 4,579,562 4/1986 Tarman et al. ..... 44/629
4,626,258 12/1986 Koppelman ..... 44/629
5,076,812 12/1991 Getsoian ..... 44/629

*Primary Examiner*—Ellen M. McAvoy
*Attorney, Agent, or Firm*—Walter G. Finch

[57] ABSTRACT

A fuel coal processing system is provided which consists of a centrifugal type pulverizer, a coal purifier and an optional fuel coal size classifier, all combined into one integral, cooperatively acting, fuel coal preparation device. The pulverizer consists of a pair of opposed multicup concentric ring rotors, mounted on a common axis, counter rotating at relatively high speed, an axially located feed tube through which material is fed into the center of the rotor system and then is thrown tangentially, progressively and outwardly from ring to ring on each of the counter rotating rotors thereby being reduced in size by the repeated high speed impacts and skidding abrasion associated with the process. The purifier consists of an annular ring nozzle surrounding the outer periphery of the pulverizer rotors through which high velocity air streams upwardly through the spray of pulverized material exiting the pulverizing rotors to vertically accelerate the less dense pure coal particles to strata relatively higher than the more dense impure material. The pyritic material is split off and rejected while the coal product then passes through size classifier means. Oversize coal is thrown out of the air stream and is returned to the mill for further reduction. Triboelectrostatic purification means may also be used alone or in conjunction with the aerodynamic means to more effectively handle different conditions and kinds of coal.

12 Claims, 5 Drawing Sheets

GAP WIDTH= 5 INCHES

D= 38.1 cm AIR DENSITY= 0.0013 gm/cm3

VP= 9575.574 cm/sec

AIR SPEED= 4000 FPM

VA= 2032.00 cm/sec VREL= 9788.8 cm/sec

COAL DENSITY= 1.50 gm/cm XCOAL 119.39

PYRITE DENSITY= 5.00 gm/cm XPYRITE 35.817

| DIAMETER | RADIUS (cm) | VCROSS1 | VCROSS2 | DEFLECTION COAL | DEFLECTION PYRITE | RISE ANGLE COAL | RISE ANGLE PYRITE |
|---|---|---|---|---|---|---|---|
| 1/8 INCH | 0.1588 | 752 | 226 | 0.99 | 0.29 | 1.66 | 0.48 |
| 1/16 INCH | 0.0794 | 1504 | 451 | 2.07 | 0.59 | 3.44 | 0.98 |
| 1/50 INCH | 0.0254 | 4700 | 1410 | 7.66 | 1.93 | 12.63 | 3.21 |
| 1/100 INCH | 0.0127 | 9401 | 2820 | 19.50 | 4.16 | 30.55 | 6.91 |
| 1/200 INCH | 0.0064 | 18802 | 5640 | 52.42 | 9.66 | 65.22 | 15.84 |
| 1/300 INCH | 0.0042 | 28202 | 8461 | 75.34 | 16.76 | 81.08 | *26.66 |
| 1/400 INCH | 0.0032 | 37603 | 11281 | 84.59 | 25.51 | 86.75 | **38.49 |

ROTOR SPEED= 1800 rpm= 188.4956 rad/sec

TEMPERATURE 500 F

TEMP FACTOR 0.512195

AIR FLOW RATE:

ROTOR RADIUS: 20 INCHES= 50.8 cm

AREA OF GAP: 4560.367 cm2

AV= 9266666 cm3/sec= 19,635 cfm

MASS FLOW= 5932.927 gm/sec= 23.49 TONS PER HOUR

* THIS SMALL COAL ANGLE, 30.53° IS GREATER THAN THE LARGE PYRITE ANGLE, 26.66° IN THE RANGE OF MAXIMUM PRODUCTION RESULTS

** -400 PYRITE MAY BE REMOVED ELECTROSTATICALLY

FIG. 4

COAL PULVERIZER PURIFIER CLASSIFIER

FIELD OF THE INVENTION

This invention relates generally to methods and apparatuses for processing coal for burning, with less environmental contamination, in steam generation boilers such as are used in electric power generation facilities, and more particularly to a coal pulverizer-purifier-classifier used in conjunction therewith.

PRIOR ART AND BACKGROUND OF INVENTION

More specifically, the purpose of this invention is to improve the technology of pulverizing coal for burning in electric power generation boilers. This is done with a machine that is basically a system of spinning counter rotating rotors uniquely combined with means for electrostatically and/or aerodynamically separating the fine pure coal from the pyritic and other impurities.

As chunks of coal are fed in through an axial center mounted feed tube, they are caused to smash repeatedly, at high velocity, onto other coal chunks and particles which have accumulated on the rings. By having the coal particles themselves act as the primary abrasion and reduction agents, material wear is minimized. Reduced in size from the series of abrasive collisions, the particles finally exit as an evenly dispersed circumferential spray of very fine material. At this point in the process, an in-stream aerodynamic and/or electrostatic separation action can readily be utilized to remove a high percentage of the sulfur and iron pyritic impurities contained therein.

Currently used pulverizing technology uses direct crushing means such as hammer mills, ball mills or roll mills of various configurations. In these mills, air is swept through the mill and as the coal is reduced to a fine enough size to be airborne the dust particles are entrained in the air stream and carried out of the mill to the combustor.

For material to leave the mill it has to stay in the mill until it is reduced to dust fine enough to become airborne by repeated crushing actions of the rolling or flailing elements of the mill. Pure coal and impure coal both leave the mill when ground down fine enough to be swept up by the air currents blowing through the mill. Therefore, significant separation of pure and impure coal does not take place in these types of reduction mills.

When coal is mined, it often carries impurities mixed in its seams in the form of streaks ranging from small fractions of an inch to several inches in thickness. These stratified streaks of impurities are chiefly composed of both iron pyrites and sulfur, and when intermixed with the coal, comprise what is known as "bone" coal. Sulfur can also appear as chunks called "sulfur balls". The large ones are taken out at the mine, but some small ones may get through. The bone coal is approximately three and a third times more dense and considerably harder than pure coal. Being harder, the bone coal requires greater energy in the form of collisions to reduce to dust in conventional mills. Yet, the mechanical crushing elements found in these types of mills do eventually reduce the bone coal to a fine enough size to be carried out to the boiler burners by the air sweeping elements.

Thus, this conventional system of reduction offers a major drawback since the reduction of bone coal in these mills is not only useless, but the additional crushing power required to reduce the bone coal as well as the metal on metal contact produced therein results in high amounts of wear on mechanical parts. The present invention seeks, as one of its purposes, to use a means of reduction that will break down the soft friable coal but not crush the hard bone coal as much. This reduction process will reduce the pure coal to dust form and leave the impure coal in relatively larger, harder, and heavier chunks so that a simple separation process that recognizes these different characteristics will reject the bone coal, with its impurities, before it can be carried to the combustors.

The construction and operation apparatus and system will be described for pulverizing the coal. Also, two means will be shown for separating out the impurities, followed by size classifying means that will separate combustible size coal dust and oversize chunks that are returned to the mill for further reduction.

The use of this unique system of fuel preparation makes it possible to utilize in power generation and heating plants the so called high sulfur coals from the eastern states without high pollution effects on the atmosphere.

OBJECTS OF THE INVENTION

It is an object of this invention to improve the technology associated with pulverizing coal for burning in electric power generation systems.

Another object of this invention is to provide a novel coal pulverizer purifier classifier.

To provide a novel coal pulverizer purifier classifier which essentially reduces pure coal more than pyrite coal is another object of this invention.

Still another object of this invention is to provide a coal pulverizer purifier classifier which uses an aerodynamic density differentiator to reject a high percentage of the impurities as the coal travels through the processor.

Yet another object of this invention is to provide a coal pulverizer purifier classifier which may incorporate a triboelectrostatic charge differentiator to reject extremely small impurity particles and subsequently produce a cleaner final coal product.

To provide a novel coal pulverizer purifier classifier which uses a size classifier to return oversize coal chunks to the mill for further reduction is another object of this invention.

And to provide a novel coal pulverizer purifier classifier which is economical to manufacture and both efficient and reliable in operational use is still another object of this invention.

BRIEF DESCRIPTION OF THE DRAWINGS

These and other attendant advantages and objects of this invention will be obvious and apparent from the following detailed specification and accompanying drawings in which:

FIG. 4 illustrates data of computed deflection of different particle masses under a given set of physical and aerodynamic conditions;

DESCRIPTION OF THE PREFERRED EMBODIMENTS

Referring now to FIGS. 1 to 6 of the drawings, there is shown the preferred embodiment of a coal pulverizer purifier classifier. In operational use, the coal feedstock passes through an attrition mill where it is reduced, and across an aerodynamic density differentiator where a high percentage of impurities are rejected. The feedstock is then finally passed through a size classifier section 13 where the coal is passed along to a combustor if it is sufficiently small, or mixed in with incoming feed stock to be recirculated in the attrition mill for further reduction if it is too big. In one embodiment of the invention, a tribo-electrostatic charge differentiator acts to reject impurities on the order of 1/400 of an inch or less which would otherwise get mixed in with the pure coal, thereby producing a cleaner final coal product.

Figure 1:
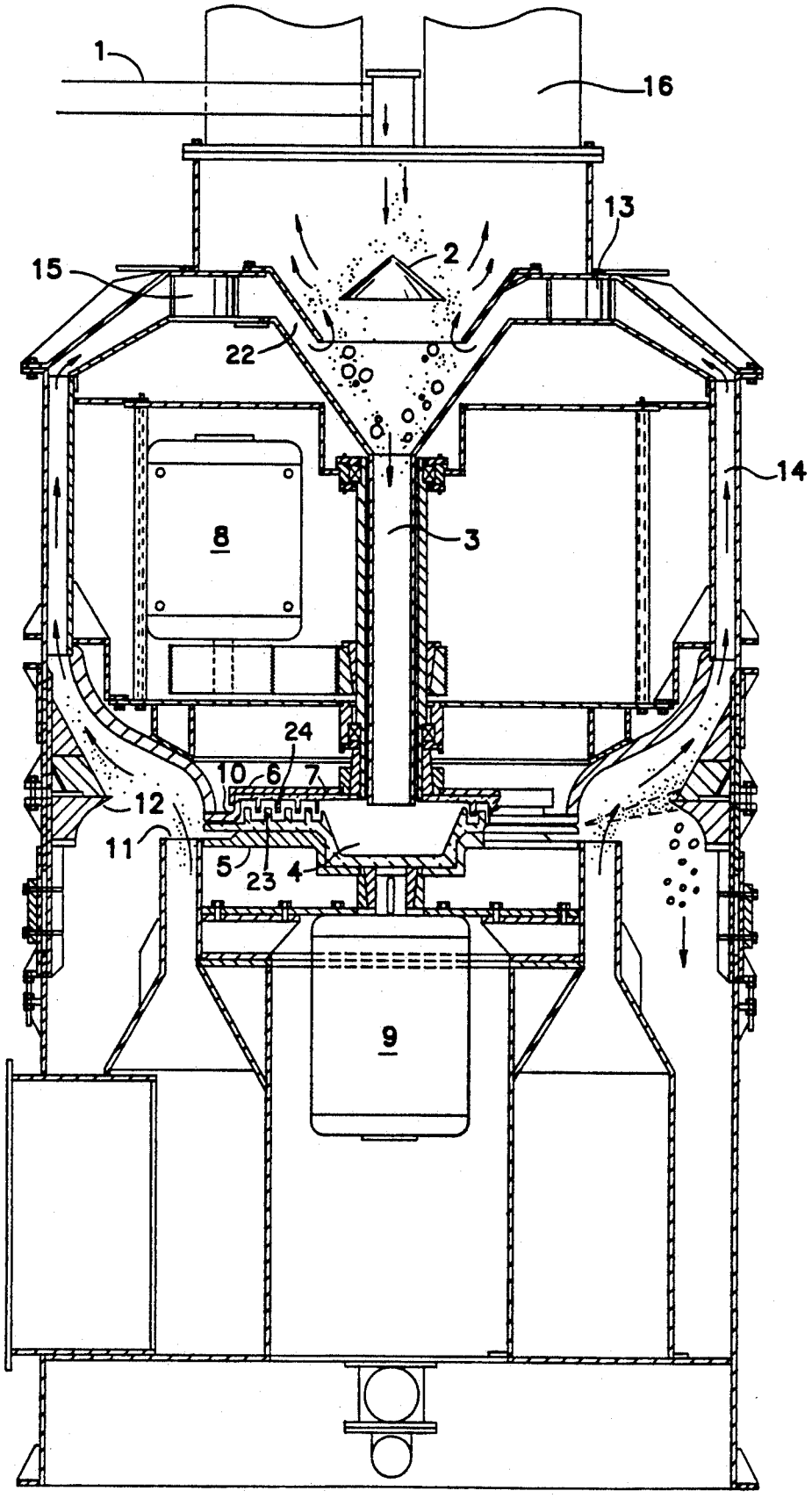
FIG. 1 is a sectional elevation through an aerodynamic model incorporating features of this invention.
Figure 2:
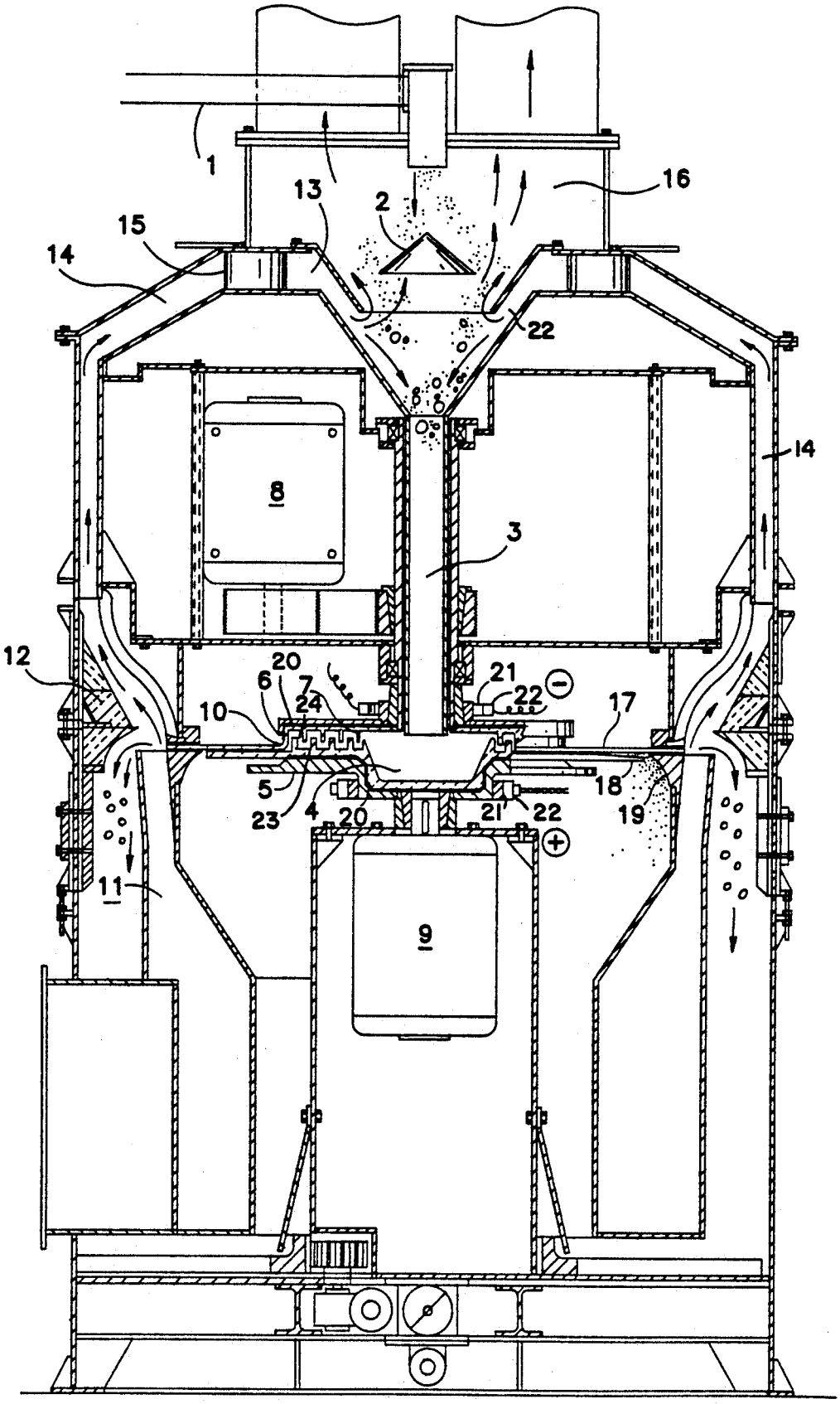
FIG. 2 is a sectional elevation through a combined aerodynamic and electrostatic model.

FIG. 1 illustrates a vertical section view of the total system using only aerodynamic means to separate out the pyritic impurities from the coal, while FIG. 2 illustrates the aerodynamic and triboelectrostatic means working in complementary relationship. Either system takes the form of a basically symmetrical cylindrical structure, except for the fuel infeed conveyor, the air infeed duct and the impurities conveyor.

Raw coal is fed into the mill with coal stock infeed conveyor 1. It falls down over a spreader cone 2 and down through a feed pipe 3. The coal lands in a center cup 4 of rapidly spinning lower rotor 5. A counter rotating spinning upper rotor 6 carries a first upside down cup 7, which receives the coal flying tangentially off the center cup 4 and, in turn, flings it tangentially on over to the next cup on the lower rotor 5.

From the drawings, it can be seen that each rotor 5 is formed by attaching a series of concentric rings to a base plate to form a series of cup-type cavities hereinafter referred to as either cups or rings. These rings bank up with material 23 to form the conical working surfaces 24 where the impacting and abrading actions occur, as best shown in FIG. 6.

Figure 6:
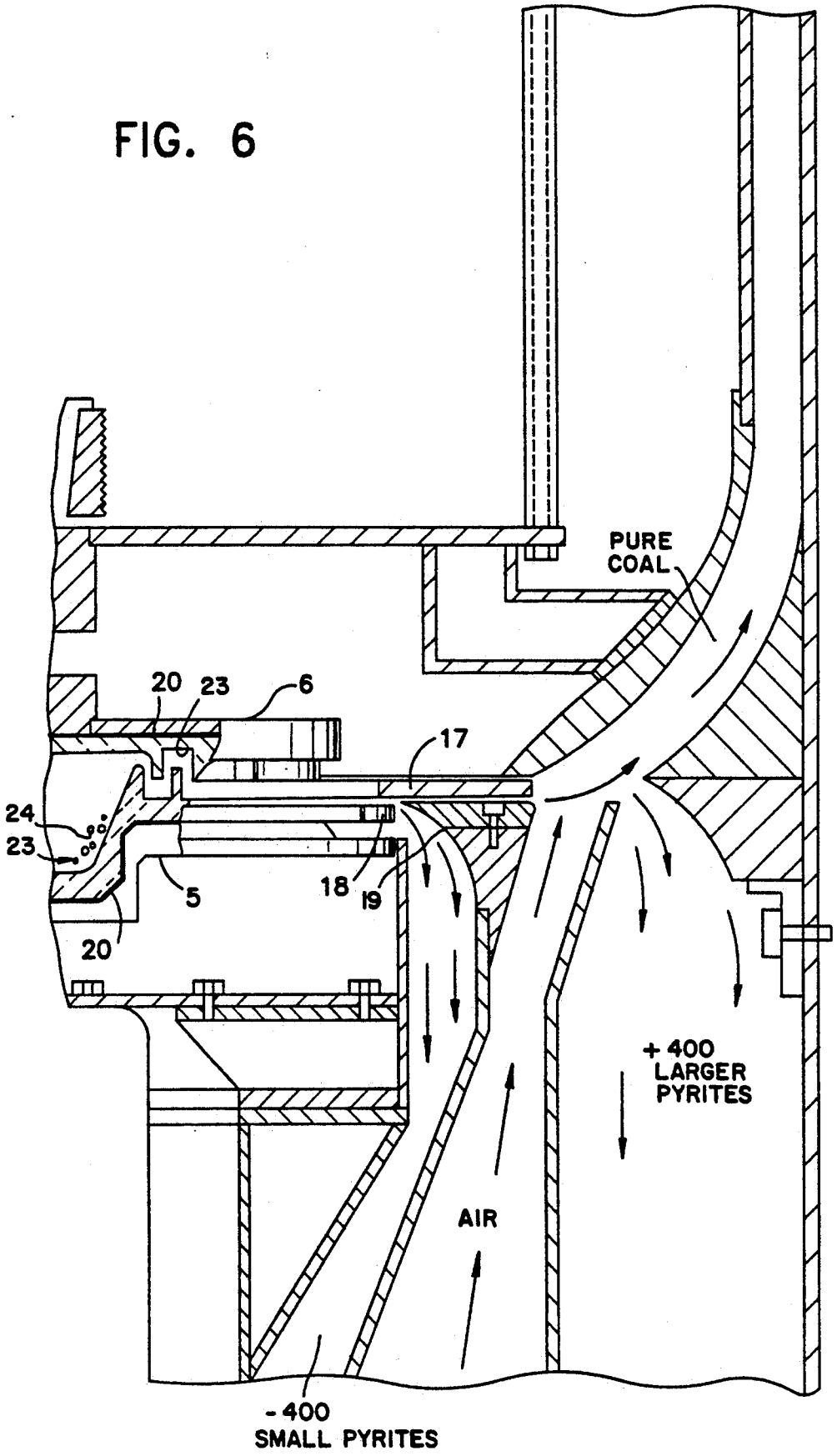
FIG. 6 is an enlarged view of a ring scoop placed to remove very small negatively charged pyritic particles after being deflected down into the path of the ring scoop.

This action continues from the upper cup to a lower cup until the coal has passed over all the coal banked rings on both lower and upper rotors 5 and 6, shown in FIGS. 1, 2 and 6. The size reduction action of the coal occurs as the high speed counter rotating rotors 5 and 6 throw the coal from ring to counter rotating ring, causing very destructive high speed head-on collisions between particles. Also, destructive abrasive action occurs as the particles skid to a stop relative to the conical working surface 24, shown best in FIG. 2, of each conical section formed by a coal-banked ring followed by acceleration back in the opposite direction.

Slower speeds will pulverize softer materials but it takes higher speeds to reduce harder and stronger materials such as bone coal. Therefore, by setting the speed of rotation to an optimal level, the attrition of pure coal can be maximized while that of the harder bone coal can be minimized. Setting this optimal rotor rotation speed can readily be done by adjusting the upper drive motor 8 and lower drive motor 9 which revolve the upper and lower rotors 6 and 5, respectively. In order to do this, the motors 8 and 9 will have to be of the variable speed type. Setting the attrition mill at this optimal speed will result in two distinguishable classes of material emerging from the spinning rotors 5 and 6: pure coal which will be lighter and finer and bone coal which will be heavier, coarser, and larger.

As the coal shatters from head-on collisions some of it may break into chunks with bone coal carrying pure coal on one or two sides. The abrasive action just described will tend to grind purer coal away from the harder bone coal, leaving a relatively denser chunk of impure material that can be separated out of the stream of fuel going through the processor.

Following the pulverization of the coal in the attrition mill comes the purification stage. It can be either an aerodynamic or triboelectric system working individually or in combination. The aerodynamic version is a density difference separator that works as follows.

Coming out over the last ring of the attrition mill the spray pattern will be a flat thin spray of radially flying pulverized material. The flatness of the spray is caused by the special radius lip design of the last rotor ring to engage the coal. Other means may be used to ensure a flat spray of material.

As the spray of material leaves the rotor, a high velocity air stream, rushing up from below through a concentrically located ring nozzle 11, shown in FIGS. 1 and 2, passes vertically through this thin sheet of material and will act with equal force per unit cross sectional area on all particles flying through it.

The concentrically shaped and mounted separation splitter blade or ring 12, shown in FIGS. 1 and 2, is set at an elevation high enough above the base trajectory so that bone coal particles of high specific gravity or density will pass under it because they will not accelerate in the upward direction as quickly as the low density coal particles. Size is relatively unimportant but relative density at this point is significant.

Figure 3:
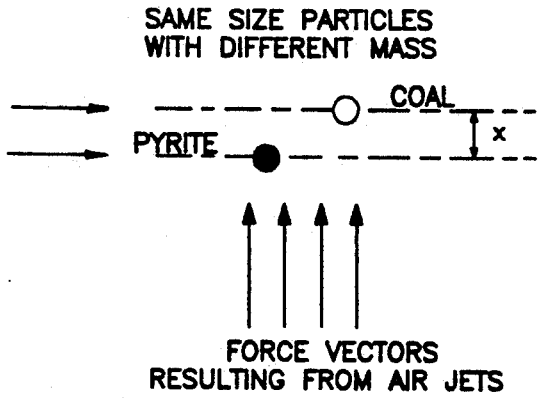
FIG. 3 is an action illustration of vertical air jet force vectors on particles of the same volume but different mass.

FIG. 3 illustrates the difference in vertical acceleration rates between two particles of the same size but different weight. The dark particle is the same size as the lighter particle, yet it weighs more because it is more dense. Being the same size, the two particles have the same "sail" area. Having the same "sail" areas, the two particles experience equal lifting forces as signified by the four vertical force vector arrows indicating equal lifting force components. Since equal forces applied to bodies of different weights produce unequal accelerations, the lighter body will accelerate faster than the heavier body. This unequal acceleration results in the vertical displacement distance x between the two bodies, assuming they were launched at the same elevation and both with only a horizontal component of speed.

In the case of this invention, the two bodies of different density are the pure coal particles and the bone coal particles. Therefore, both being propelled horizontally at equal speeds through a vertically rising air jet, a pure coal particle of the same size as a bone coal particle will accelerate more quickly and reach the terminal wall above the splitter ring 12, while the bone coal particle will reach the terminal wall below the splitter ring 12. The pure coal particle will then be further elevated to the size classifier section 13, while the bone coal particle will fall into a rejection chute.

Figure 5:
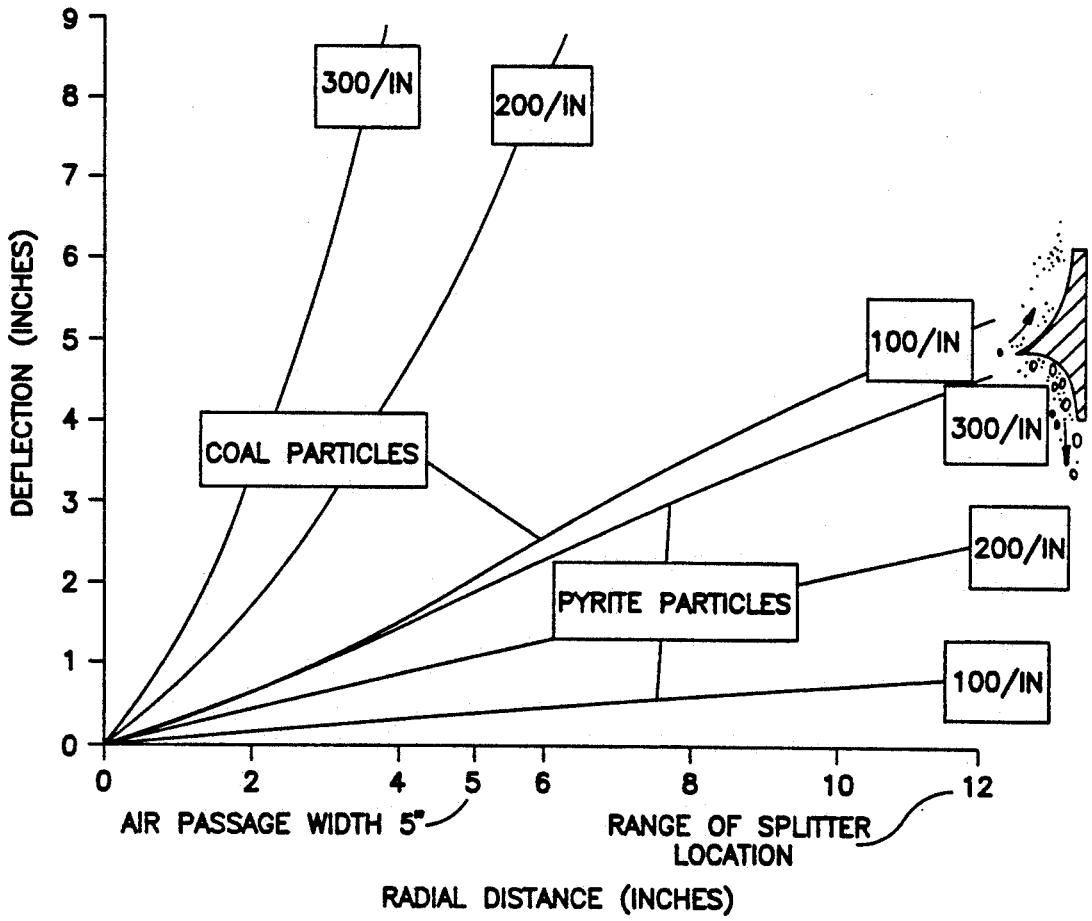
FIG. 5 is a graph of data of trajectories taken by particles of different mass under the action of a vertical air jet.

FIG. 4 lists a set of calculations that show the degree of deflection of a given group of pulverized particles under a specific set of conditions. The calculations clearly show that coal particles deflect over three times as high as impurities of the same size over a given horizontal distance. This phenomena is also indicated in the rise angles for the coal particles, which are much greater than those of the same sized pyritic impurities. The data also suggests that, for a forty inch rotor system such as that previously mentioned running at 1800 rpm with air blowing through a five inch wide circular air nozzle and passing vertically through the sheet of particle flow, mounting the splitter ring 12 twenty-seven degrees above the rotor plane will result in absolutely no pyrites except those on the order of 1/400 of an inch clearing the splitter ring 12 and passing on up to the size classifier section 13 with the rest of the pure coal particles. Since the material has passed through the attrition mill, almost no coal at this point will be greater than 1/100 of an inch, and subsequently, very few coal particles fail to clear the splitter ring 12 only to be wasted with the rest of the rejected impurities. FIG. 5 is a graphic set of curves showing the trajectories of the particles of FIG. 4 ranging from 1/400 to 1/50 of an inch. The curves reiterate the aforementioned rise phenomena.

Though size does not play a huge role in this section, its effect must be considered. An extremely small particle will readily move with any wind current to which it is subjected. The data from FIG. 4 illustrates how particles of a given material which measure 1/400 of an inch deflect vertically up to eight times as much as particles 1/50 of an inch, over the same horizontal distance. This fact has its advantages and disadvantages. First, once the material sprays out of the rotor system, it emerges as two distinct categories of material: smaller and less dense coal particles and larger more dense impure particles. Therefore, by virtue of being smaller alone, the coal particles will have a greater tendency to rise more quickly in the vertical direction and clear the splitter ring 12. In other words, even if the emerging particles of coal and the impurities were the same density, more coal particles would still clear the splitter ring 12 since they are, at this point, smaller than their pyritic counterparts. The disadvantage which has already been mentioned is the fact that whatever impurities on the order of 1/400 of an inch exiting the rotor assembly have a good chance of clearing the splitter ring 12 and passing on with the pure coal particles to the size classifier section 13. Fortunately, the −400 mesh is a very small portion of the pyritic material. In addition, by combining a triboelectrostatic system with the aerodynamic system, this lot of −400 mesh and smaller pyritic material can also be rejected.

The triboelectrostatic separation process is based on the triboelectrostatic phenomenon. When coal and pyritic particles are broken apart from each other, the coal takes on a positive charge and the pyrities a negative charge. By passing the particles between an upper rotor negatively charged ring 17 and a lower rotor positively charged ring 18 that each surround the outer periphery of the counter rotating rotors, the coal can be deflected upwardly and the pyrites downwardly to pass under the splitter ring blade. This arrangement is shown in FIGS. 2 and 6. Contact rings 21 and brushes 22 carry the negative and positive charges to rings 17 and 18. The rings are electrically isolated with insulation 20.

The governing principle here is that opposite charges attract while like charges repel. Hence, since the positive coal particles are both attracted to the upper rotor negatively charged ring 17 and repelled away from the lower rotor positively charged ring 18, they consequently do not get engulfed in the ring scoop 19 but pass onto the exiting coal stream. Conversely, the negatively charged pyritic impurities are attracted to the lower rotor positively charged ring 18 and repelled away from the upper rotor negatively charged ring 17, thereby becoming trapped by the ring scoop 19 and rejected.

Since the triboelectric effect only works well on very small particles at these speeds of operation, it cannot be used to cover the whole spectrum of particle sizes. However, it can be effective in deflecting pyritic materials in the −400 range. The −400 pyritic material is removed by a scoop 19 in FIGS. 2 and 6, that concentrically encircles the lower rotor and is placed in the plane of rotor exiting material at an elevation just high enough that will cause it to shear through and scoop off the −400 range pyritic material that has been deflected downward by the electrostatically charged ring plates 17 and 18. (The −400 size reference is illustrative only)

Coal, with its positive charge in this size range will be deflected upwardly out of the lower scooping path and will pass on through to the exiting coal stream. Suitable means for collecting all the extracted pyritic materials and ejecting them from the system is provided as part of the process.

Next in the overall process sequence is the coal size classifier 13, shown in FIG. 2. The size classifier 13 works on the difference in centrifugal force developed by different weight bodies that are different in weight by virtue of being larger or smaller in size, not by difference in density. The density difference factor has just been discussed in the preceding described purification process. By the time the coal reaches the differential size classifier section 13, the basic difference to be accounted for is size.

Size separation is accomplished by quickly changing the direction of the coal particle bearing air stream duct 14 by directing it through size classifier vane openings 15, shown best in FIG. 2, past spreader cone 2 and on up fuel size coal air stream duct 16 on its way to a combustor. The centrifugal force imparted to the oversize particles in the air stream making the 180 degree (plus or minus) change in direction is so great that they do not make the turn and are caught up in the incoming stream of coal and are carried back through the attrition mill fur further reduction as earlier mentioned.

The size classifier 15 with various arrangements of vane openings can be constructed in various ways. It must be a properly functioning classifier that will do its job and work in conjunction with the aforesaid pulverizer and purifier stages of the overall pulverizer-purifier-classifier equipment package.

As a particular example in another variation, an infeed conveyor shown in FIG. 1, can be fitted directly to the feed pipe 3 and below the classifier 15, the oversize particles ejected by the classifier 15 can then be passed through an air lock on their way to the infeed conveyor 1. This greatly limits the amount of air allowed to pass through the pulverizing rotors, changing the turbulence characteristics at the splitter blade or blades and possibly affecting explosion probabilities.

Obviously, many modifications and variations of the present invention are possible in light of the above teachings. It is, therefore, to be understood that the invention is meant to embrance all variations of the previously described structure as well as all equivalent apparatus that fall within the scope of the appended claims.

What is claimed is:

1. A fuel coal processing system, comprising, a centrifugal type coal pulverizer means in the form of a rotor system and a density differentiating, aerodynamic coal purifier means, wherein said centrifugal type coal pulverizer means and said density differentiating, aerodynamic coal purifier means are combined into one integral fuel coal preparation device.

2. A fuel coal processing system, comprising, a centrifugal type coal pulverizer mans in the form of a rotor system, a density differentiating aerodynamic coal purifier means, and a fuel size classifier means, whereby said centrifugal type coal pulverizer means, sis density differentiating, aerodynamic coal purifier means, and said fuel size classifier means are all combined into one integral, cooperatively acting, fuel coal preparation device.

3. A fuel coal processing system as set forth in claim 1, wherein said coal pulverizer means consists of a pair of opposed multi-cup concentric ring rotors, said rotors being concentrically mounted on a common axis and counter rotating at relatively high speed, and an axially located feed tube, whereby when coarse material is fed into the center of the rotor system through said axially located feed tube and said material is centrifugally thrown tangentially, progressively and outwardly from cup to cup on each of said counter rotating rotors, said material is reduced in size from mostly chunks to practically all dust by the repeated high speed impacts and skidding abrasion associated with the process.

4. A fuel coal processing system as set forth in claim 1, wherein said pulverizer means consists of a pair of opposed multiconcentric ring rotors, mounted on a common axis, counter rotating at relatively high speed, with an axially located feed tube.

5. A fuel coal processing system as set forth in claim 1, wherein said pulverizer means consists of a pair of opposed multiconcentric ring rotors, mounted on a common axis, and counter rotating at relatively high speed, with an axially located feed tube and means to ensure that the spray of said pulverized material leaves said rotor system in a flat, radiating, sheet spray pattern.

6. A fuel coal processing system as set forth in claim 3, wherein said counter rotating rotors are individually powered by separate variable speed motors, said variable speed motors being set at such a speed to turn said counter rotating rotors at an optimal crushing velocity whereby the softer pure coal material is completely reduced to dust size particles but the harder impure kernels and chunks receive a minimal amount of reduction.

7. A fuel coal processing machine as set forth in claim 3, whereby said density differentiating, aerodynamic coal purifier means includes a stratified flow splitter blade means and an annular ring air nozzle means, wherein pulverized coal is aerodynamically purified by means in which the rotor system is concentrically surrounded by said annular ring air nozzle immediately adjacent to said rotor system and is itself surrounded by said stratified flow splitter blade means to deflect air-stratified, impure, relatively dense coal particles downwardly to a discharge chute and less dense pure coal particles upwardly to be passed onto a combustor, and whereby stratification is caused by a high velocity air stream jetting upwardly and through the sheet of pulverized material leaving the rotor system and causing the less dense pure coal to accelerate to a different plane than that of the more dense impure particles.

8. A fuel coal processing machine as set forth in claim 7, and a size classifier means, wherein the purified coal passing above said splitter blade means on the way to said combustor is carried through said size classifier means by said high velocity air stream, and whereby sufficiently reduced coal is carried to said combustor and oversize coal particles are recirculated back to said pulverizer means for further reduction.

9. A fuel coal processor as set forth in claim 5, wherein said flat, radiating sheet spray pattern of centrifugally flying pulverized coal leaving the ringed cup area of said rotors traverses a relatively close spare between an electrostatically charged ring assembly consisting of two charged rings that are dielectrically supported and carry charges of opposite polarity, the lower charged ring being positive and the upper charged ring being negative and by being so charged attract and repel upwardly triboelectric positively charged pure coal material and downwardly negatively charged pyritic material as the pulverized material leaves said electrostatically charged ring assembly to pass over a concentrically mounted scoop ring that is adjacent to said lower electrostatically charged ring and just high enough to scoop off the lower strata of negatively charged pyritic material to be rejected from the process as the remaining product passes onto a combustor.

10. A fuel coal processing machine as set forth in claim 9, wherein the fuel coal product is passed on from said electrostatically charged ring assembly and from said concentrically mounted scoop ring to a size classifier means, and whereby said size classifier means allows the oversize coal to be separated out and returned to said pulverizer means for further reduction and the fuel grade coal to be flown on through to said combustor.

11. A fuel coal processing machine as set forth in claim 9, wherein the pure coal and heavier pyrites pass on from said electrostatically charged ring assembly and from said concentrically mounted scoop ring to said density differentiating, aerodynamic coal purifier means where an upwardly moving jet of air causes pure coal to pass above an annular splitter blade means and to be further passed on through to said combustor while denser pyritic material is rejected.

12. A fuel coal processor as set forth in claim 2, wherein a pure coal portion is passed through said size classifier means, and whereby said size classifier means separates out oversize coal and sends it back through for further reduction while allowing sufficiently reduced coal to be passed through to a combustor.

* * * * *